US005302097A

United States Patent [19]

Brill

[11] Patent Number: 5,302,097

[45] Date of Patent: Apr. 12, 1994

[54] HEAT RESISTANT HOT FORMABLE AUSTENITIC STEEL

[75] Inventor: Ulrich Brill, Dinslaken, Fed. Rep. of Germany

[73] Assignee: Krupp VDM GmbH, Werdohl

[21] Appl. No.: 935,532

[22] Filed: Aug. 25, 1992

[30] Foreign Application Priority Data

Sep. 11, 1991 [DE] Fed. Rep. of Germany ..... 4130140

[51] Int. Cl.[5] ..... C22C 30/00

[52] U.S. Cl. ..... 420/584.1

[58] Field of Search ..... 420/584.1

[56] References Cited

U.S. PATENT DOCUMENTS 4,530,720 7/1985 Moroishi et al. ..... 420/584.1
4,853,185 8/1989 Rothman et al. ..... 420/584.1

FOREIGN PATENT DOCUMENTS 1453259 10/1976 United Kingdom .
1525243 9/1978 United Kingdom .
2036077 6/1980 United Kingdom .

*Primary Examiner*—Deborah Yee
*Attorney, Agent, or Firm*—Meltzer Lippe Goldstein, et al.

[57] ABSTRACT

The invention relates to a heat resistant hot formable austenitic steel consisting of (in % by weight)

| | |
|---|---|
| carbon | 0.10 to 0.20 |
| silicon | 2.5 to 3.0 |
| manganese | 0.2 to 0.5 |
| phosphorus | max 0.015 |
| sulphur | max 0.005 |
| chromium | 25 to 30 |
| nickel | 30 to 35 |
| aluminium | 0.05 to 0.15 |
| calcium | 0.001 to 0.005 |
| rare earths | 0.05 to 0.15 |
| nitrogen | 0.05 to 0.20 |

residue iron and the usual impurities due to melting.

5 Claims, 4 Drawing Sheets

HEAT RESISTANT HOT FORMABLE AUSTENITIC STEEL

The invention relates to a heat resistant hot formable austenitic steel and its use as a material for the production of heat resistant, corrosion resistant particles.

BACKGROUND OF THE INVENTION

Hitherto the steel having Material No. 1.4876 in the Steel List of the Verein deutscher Eisenhüttenleute has been used for particles which must be resistant to carbonization, sulphidization and oxidation in the temperature range of 500° to 1000° C., more particularly with cyclic stressing. The steel consists of (in % by weight) max. 0.12% carbon, max. 1.0% silicon, max. 2.0% manganese, 19–23% chromium, 30–34% nickel, 0.15–0.60% titanium, 0.15–0.60% aluminium, residue iron. For less stringent corrosion conditions that steel is a cheap alternative to the high nickel containing materials, for example, the nickel alloy having Material No. 2.4856.

However, this austenitic steel 1.4876 shows heavy carbonization at temperatures above 900° C., taking the form of a distant increase in weight due to heavy carbide precipitations and carbon absorption. As a result the mechanical properties, more particularly long-term strength, are also unfavourably affected thereby. The austenitic steel 1.4876 shows clear damage due to sulphur absorption even in oxidizing/sulphidizing conditions such as, for example, a gaseous atmosphere of nitrogen and 10% $SO_2$ at 750° C.

The austenitic steel disclosed in EP 0 135 321 containing details in % by weight) max. 0.03% carbon, 20–35% chromium 17–50% niobium and 2–6% silicon, is as a result of its high silicon content resistant to corrosion in heavily oxidizing mineral acids, such as nitric acid, but is not suitable for use at temperatures above 500° C. in carbonizing, sulphidizing and oxidizing conditions.

GB PS 2 036 077 discloses an austenitic steel consisting of (details in % by weight): max. 0.10% carbon, 1–5% silicon, max. 3% manganese, 15–30% chromium, 7–45% nickel, max. 0.10% aluminium, calcium+rare earths to a maximum total of 0.10% and max. 0.03% nitrogen.

In comparison with the aforementioned steel of Material No. 1.4876, this steel shows improved resistance to oxidation with cyclic loading at temperatures up to 1100° C., more particularly due to carbon contents which are lower than 0.10% by weight and also by a limitation of the sulphur content to values smaller than 0.003, preferably 0.0015% by weight. However, due to the limitation of the carbon and nitrogen contents to lower than 0.10 and 0.03% by weight respectively to obtain improved resistance to oxidation, the heat resistance of the material is inadequate in the temperature range indicated for its use. Moreover, it is technically very expensive to obtain these limitations in carbon, nitrogen and sulphur during the melting of this steel.

It is an object of the invention to provide an austenitic steel which can be used without limitation in the temperature range of 500° to 1000° C. in carbonizing, sulphidizing and oxidizing conditions, more particularly with cyclic stressing.

BRIEF STATEMENT OF THE INVENTION

This problem is solved by an austenitic steel consisting of (in % by weight)

| | |
|---|---|
| carbon | 0.10 to 0.20 |
| silicon | 2.5 to 3.0 |
| manganese | 0.2 to 0.5 |
| phosphorus | max 0.015 |
| sulphur | max 0.005 |
| chromium | 25 to 30 |
| iron | 30 to 35 |
| aluminium | 0.05 to 0.15 |
| calcium | 0.001 to 0.005 |
| rare earths | 0.05 to 0.15 |
| nitrogen | 0.05 to 0.20 |

residue iron and the usual impurities due to melting.

The steel according to the invention can advantageously be used as a material for the production of articles which must be resistant to carbonization, sulphidization and oxidation at temperatures in the range of 500° to 1000° C., more particularly cyclic stressing.

It is preferably used as a material for the production of installations for thermal garbage disposal or for coal gasification and components of such installations. More particularly in the case of garbage disposal in incineration installations, the furnace components are heavily cyclically stressed by changing temperatures during heating and cooling and also by fluctuations in the composition of the waste gas.

The steel is also outstandingly suitable as a material for heating conductors in which the first requirement is satisfactory resistance to oxidation at temperatures up to 1000° C. Since in furnaces such as firing kilns the heating gases exert a heavily carbonizing effect on incorporated furnace components and moreover sulphur contaminations may occur, in dependence on the fuel used, the alloy according to the invention can be used without limitation as a material for the production of thermally stressed incorporated furnace components, such as supporting frameworks for firing kilns, conveyor rails and conveyor belts The advantageous corrosion behaviour of the steel according to the invention is achieved by:

Silicon contents of 2.5–3.0% by weight in combination with 25–30% by weight chromium have a favourable effect on resistance to sulphidization. Moreover, these silicon contents produce a formability by rolling and forging which is still adequate. Nor do the selected silicon contents adversely affect the weldability of the material.

The nickel content of 30–35% by weight in combination with 2.5–3.0% by weight silicon produces the resistance in heavily carbonizing media.

The chromium contents of 25–30% by weight in combination with a calcium content of 0.001–0.005% by weight, and also a total content of 0.05–0.15% rare earths, such as cerium, lanthanum and the other elements of the group of actinides and lanthanoids) produce excellent resistance to oxidation, more particularly in cyclic/thermal operating conditions, due to the build-up of a thin, satisfactorily adhering and protective oxide layer.

In completion of those ranges of contents of the aforementioned elements which are important for corrosion behaviour the fixing of the carbon content at 0.10–0.20% by weight in combination with nitrogen contents of 0.05–0.20% by weight is the reason for the satisfactory heat resistance and creep strength of the alloy according to the invention.

The carbon and nitrogen contents present in solution act as highly efficient mixed-crystal-solidifying elements which therefore enhance heat resistance.

Moreover, the carbon and nitrogen contents in the limits stated produce precisely in the temperature interval indicated for their use an increased precipitation of chromium carbides and chromium carbonitrides, which also enhance heat strength.

DESCRIPTION OF PREFERRED EMBODIMENT

The steel according to the invention (alloy A) will now be explained in greater detail in comparison with the prior art steel 1.4876 (alloy B).

Table 1 shows actual content analyses of the compared alloys A and B (details in % by weight)

TABLE 1

| | Alloy A | Alloy B |
|---|---|---|
| Carbon | 0.14 | 0.06 |
| Silicon | 2.77 | 0.45 |
| Manganese | 0.36 | 0.70 |
| Phosphorus | 0.014 | 0.010 |
| Sulphur | 0.003 | 0.003 |
| Chromium | 27.75 | 20.50 |
| Nickel | 30.40 | 30.50 |
| Aluminium | 0.05 | 0.25 |
| Calcium | 0.002 | — |
| Rare earths | 0.075 | — |
| Nitrogen | 0.08 | 0.02 |
| Titanium | — | 0.34 |
| Iron | residue | residue |

Figure 1:
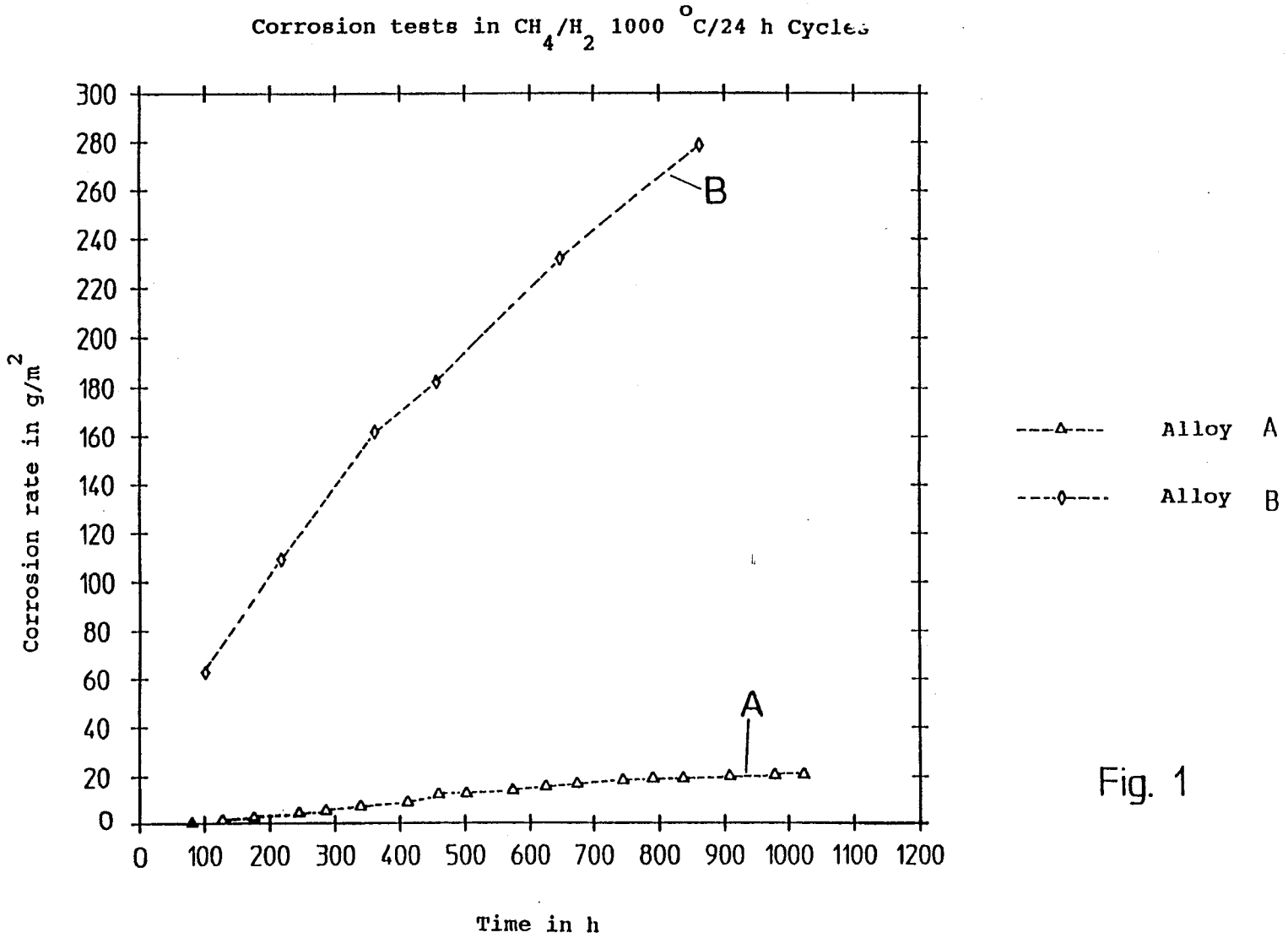

FIG. 1 shows the carbonization behaviour of steel A in comparison with alloy B.

The specific change in weight in $g/m^2$ is plotted over the time in hours. The test medium was a gaseous mixture of $CH_4/H_2$ with a carbon activity of $a_c=0.8$. The test temperature was 1000° C.

The test was performed cyclically - i.e., with a cycle lasting 24 hours the holding time at test temperature was 16 hours with a total of 8 hours heating and cooling. Alloy A according to the invention showed a clearly lower increase in weight than the comparison steel B.

Figure 2:
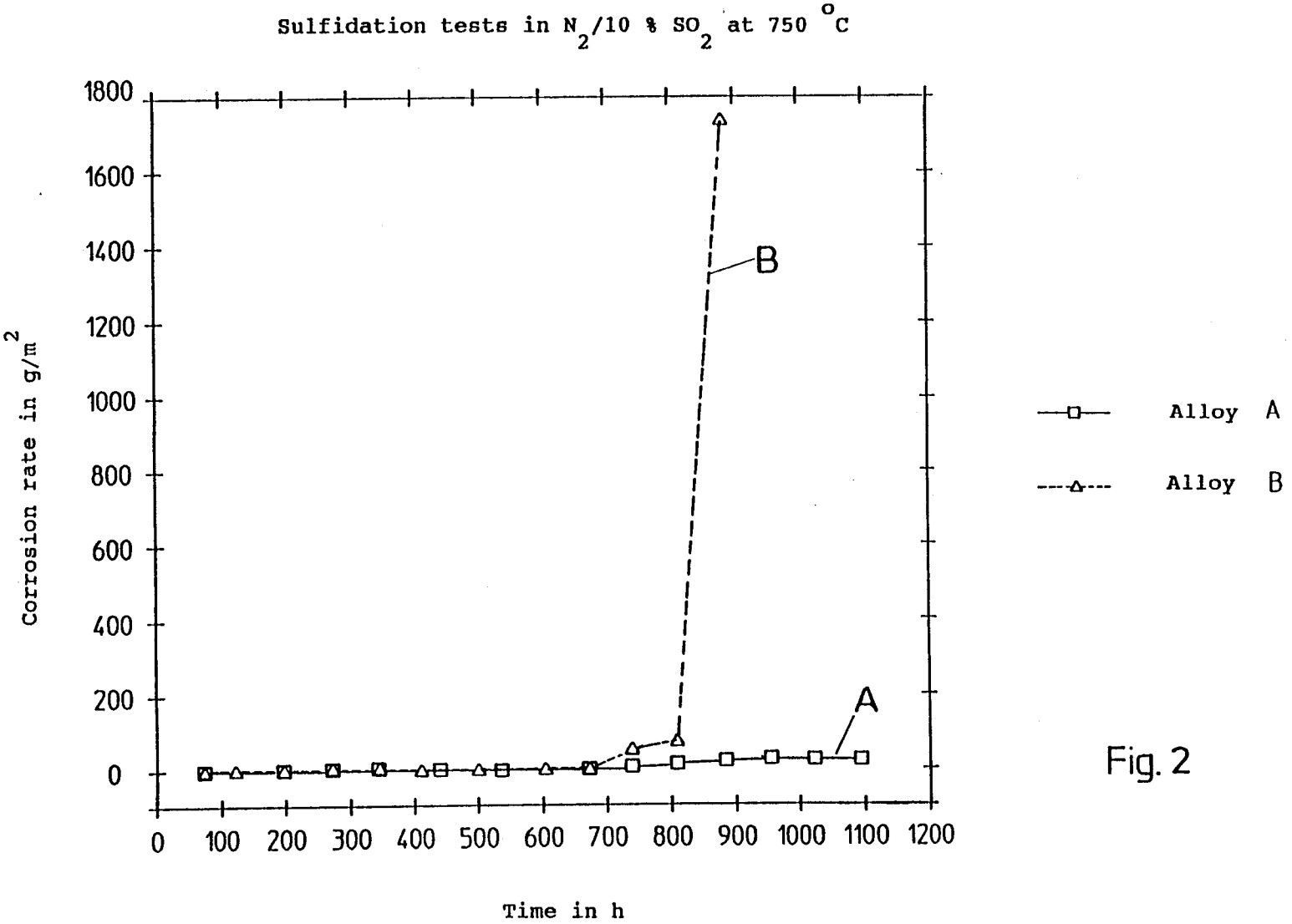

FIG 2. The presentation and test method corresponded to those shown in FIG. 1, except that in this case the test medium was nitrogen+10% $SO_2$ tested at 750° C. for resistance to sulphidization. This test also showed alloy A to be superior to alloy B as regards change in weight.

Figure 3:
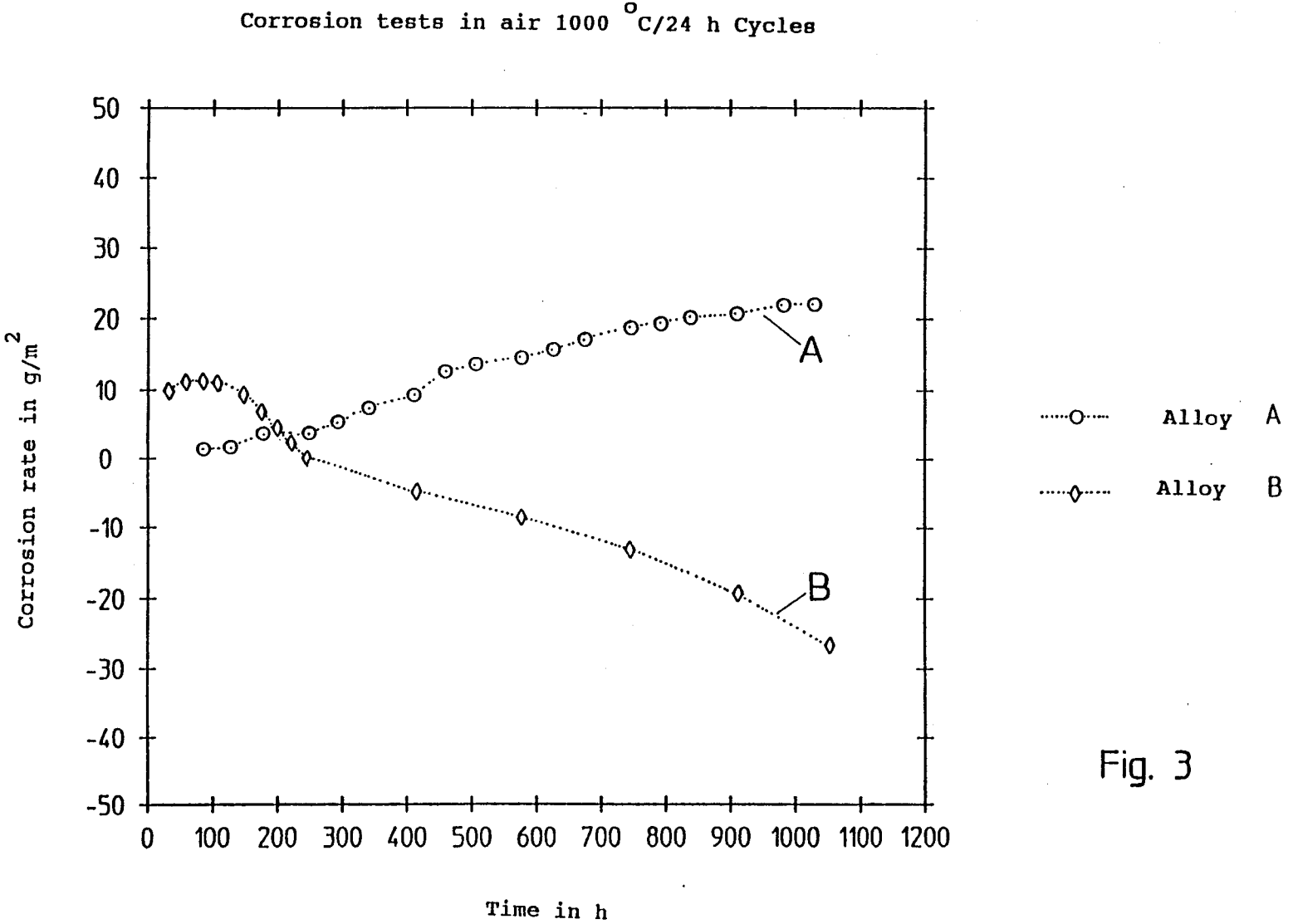

FIG. 3 illustrates the cyclic oxidation behaviour of the comparison materials A and B in air at 1000° C. The test material and presentation of the results correspond to those in FIG. 1. The clearly improved oxidation behaviour of alloy A according to the invention with cyclic temperature stressing can be seen from the increase in weight (change in weight=(+)) still measured even after more than 1000 hours of testing, something which is a proof of the presence of a satisfactorily adhering oxide layer. The losses in weight of the comparison alloy B (change in weight =(−)) mean that in these oxidizing conditions this alloy shows heavy scale peeling - i.e., it fails when used in practice.

Figure 4:
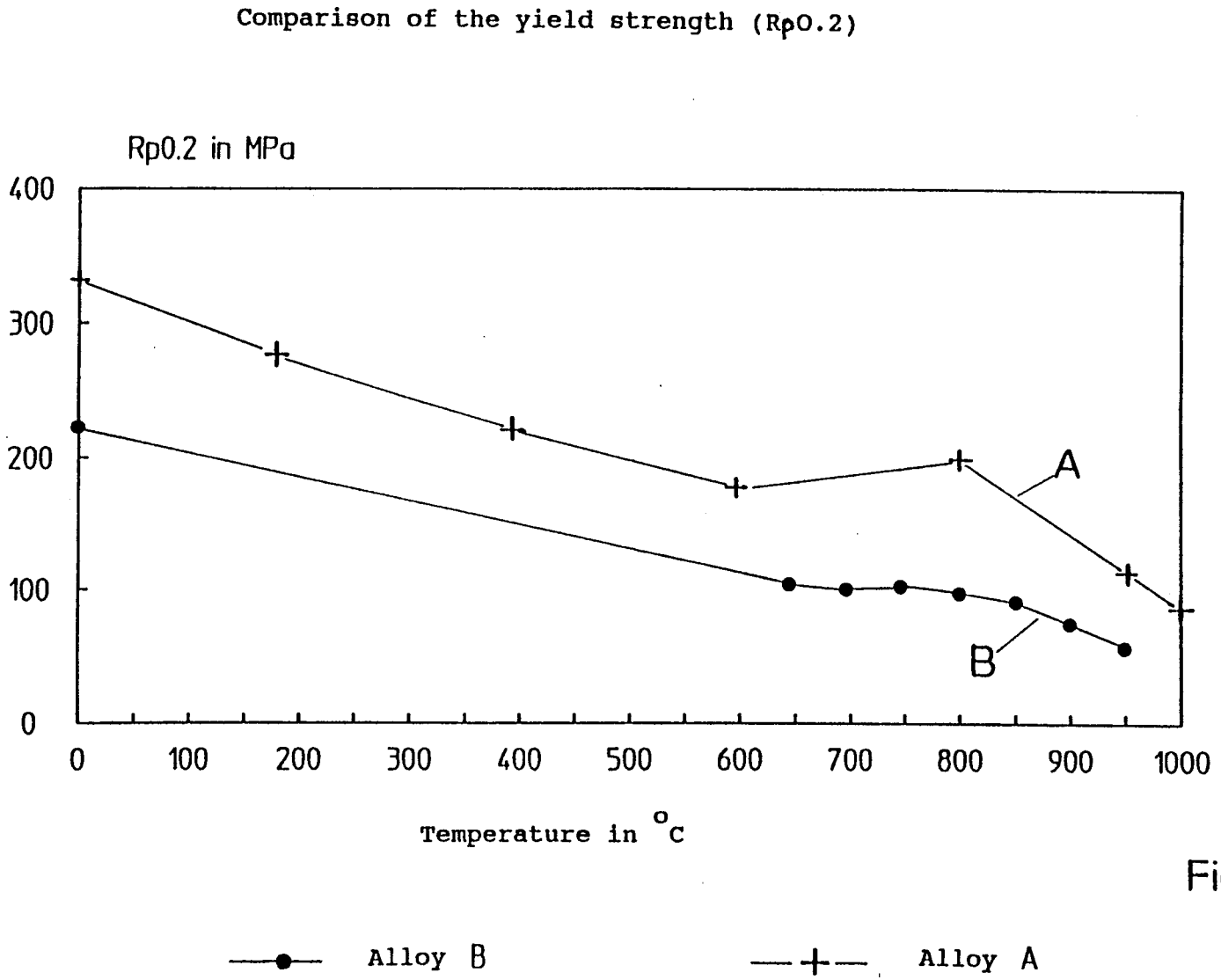

FIG. 4 shows the heat resistance in MPa from the example of the 0.2% proof stress ($Rp_{0.2}$) in dependence on the test temperature in ° C. The alloy A according to the invention had a 0.2% proof stress approximately 100 MPa higher not only in the temperature range of 500° to 1000° C., but also in the range from room temperature to 500° C. This has a particularly advantageous effect during heating and cooling operations, to which the material is inevitably subjected when used in practice.

Wording on drawings:

FIG. 1 (caption): Corrosion tests in $CH_4/H_2$, cycle 1000° C./24 hours. Ordinate=specific change in weight in $g/m^2$; abscissa=time in hours: Legierung=alloy.

FIG. 2 (caption): Sulphidization tests in $N_2$/10% $SO_2$ at 75° C. Ordinate=specific change in weight in $g/m^2$; abscissa=time in hours.

FIG. 3 (caption): Corrosion tests in air, cycle 1000° C./24 hours. Ordinate=specific change in weight in $g/m^2$; abscissa=time in hours.

FIG. 4 (caption): Comparison of the 0.2% proof stresses ($Rp_{0.2}$). Ordinate=$Rp_{0.2}$ in MPa; abscissa=-temperature in ° C.

What is claimed is:

1. A heat resistant hot formable austenitic steel which is resistant to carbonization, sulphidization and oxidation at temperatures in the range of 500° to 1,000° C. even under conditions of cyclic stressing, consisting essentially of, in % by weight,

| | |
|---|---|
| carbon | 0.10 to 0.20 |
| silicon | 2.5 to 3.0 |
| manganese | 0.2 to 0.5 |
| phosphorus | max 0.015 |
| sulphur | max 0.005 |
| chromium | 25 to 30 |
| nickel | 30 to 35 |
| aluminum | 0.05 to 0.15 |
| calcium | 0.001 to 0.005 |
| rare earths | 0.05 to 0.15 |
| nitrogen | 0.05 to 0.20 |

balance iron and usual impurities due to melting.

2. An installation for thermal garbage disposal made from the austenitic steel of claim 1.

3. An installation for coal gasification made from the austenitic steel of claim 1.

4. A heat conductor made from the austenitic steel of claim 1.

5. A furnace including components made from the austenitic steel of claim 1.

* * * * *